US007537622B2

(12) United States Patent
Dunlop et al.

(10) Patent No.: US 7,537,622 B2
(45) **Date of Patent: *May 26, 2009**

(54) PROCESS FOR DRYING COAL

(75) Inventors: Donald D. Dunlop, Miami, FL (US); Leon C. Kenyon, Jr., Baton Rouge, LA (US)

(73) Assignee: FMI Newcoal, Inc., Highland Ranch, CO (US)

( * ) Notice: Subject to any disclaimer, the term of this patent is extended or adjusted under 35 U.S.C. 154(b) by 766 days.

This patent is subject to a terminal disclaimer.

(21) Appl. No.: 10/978,768

(22) Filed: Nov. 1, 2004

(65) Prior Publication Data

US 2005/0188608 A1 Sep. 1, 2005

Related U.S. Application Data

(63) Continuation-in-part of application No. 09/974,320, filed on Oct. 10, 2001, now abandoned.

(51) Int. Cl.
*C10L 5/00* (2006.01)

(52) U.S. Cl. ..... 44/626; 44/620

(58) Field of Classification Search ..... 44/620, 44/626

See application file for complete search history.

(56) References Cited

U.S. PATENT DOCUMENTS 3,047,473 A * 7/1962 Schmidt ..... 201/4
3,424,573 A 1/1969 De Villiers
4,071,151 A 1/1978 Farber
4,140,228 A 2/1979 Hathaway
4,142,868 A 3/1979 Gencsoy
4,149,228 A 4/1979 Adamson, Jr.
4,282,006 A 8/1981 Funk
4,324,544 A 4/1982 Blake
4,341,530 A 7/1982 Loth
4,353,427 A 10/1982 Stock
4,430,963 A 2/1984 Finet
4,468,232 A 8/1984 Funk
4,486,894 A 12/1984 Page
4,495,710 A 1/1985 Ottoson
4,497,122 A 2/1985 Nelson
4,571,174 A 2/1986 Shelton
4,575,418 A 3/1986 Robbins
4,795,037 A 1/1989 Rich, Jr.
4,852,384 A 8/1989 Woolbert
5,030,054 A 7/1991 Reschly
5,050,310 A 9/1991 Jiles
5,087,269 A 2/1992 Cha
5,145,489 A 9/1992 Dunlop
5,171,474 A 12/1992 Tono (Continued)

*Primary Examiner*—Cephia D Toomer
(74) *Attorney, Agent, or Firm*—Howard J. Greenwald

(57) ABSTRACT

A multistage process for drying coal in which coal is passed into a first fluidized bed reactor at a temperature of 300 to 550 degrees Fahrenheit, air is fed into the first reactor in order to maintain the density of the fluidized bed at from 20 to 50 pounds per cubic foot, and from about 40 to about 60 percent of the water from the coal is removed from the coal and the first reactor. The partially dried coal is then fed to a second fluidized bed reactor which is maintained at a temperature at least 50 degrees Fahrenheit higher than that present in the first reactor, and substantially all of the water remaining in the coal is removed from the coal.

14 Claims, 4 Drawing Sheets

U.S. PATENT DOCUMENTS 5,174,799 A 12/1992 Garcia-Mallol
5,197,398 A 3/1993 Levy
5,265,774 A 11/1993 Stone
5,327,717 A 7/1994 Hauk
5,361,513 A 11/1994 Woessner
5,396,260 A 3/1995 Adel
5,411,560 A 5/1995 Mainwaring et al.
5,442,919 A 8/1995 Wilhelm
5,444,733 A 8/1995 Coassin
5,462,932 A 10/1995 Brenner
5,471,955 A 12/1995 Dietz
5,477,850 A 12/1995 Zegler
5,503,646 A 4/1996 McKenny
5,521,132 A 5/1996 Talmy
5,527,365 A 6/1996 Coleman
5,534,137 A 7/1996 Griggs et al.
5,537,941 A 7/1996 Goidich
5,546,875 A 8/1996 Selle
5,547,549 A 8/1996 Fraas
5,562,884 A 10/1996 Oakes
5,568,896 A 10/1996 Adams
5,612,003 A 3/1997 Heumann
5,625,119 A 4/1997 Tischler
5,830,246 A 11/1998 Dunlop
5,830,247 A 11/1998 Dunlop
5,858,035 A 1/1999 Dunlop
5,904,741 A 5/1999 Dunlop
6,126,265 A 10/2000 Childers
6,162,265 A 12/2000 Dunlop

* cited by examiner

PROCESS FOR DRYING COAL

CROSS-REFERENCE TO RELATED PATENT APPLICATION

This application is a continuation-in-part of applicant's patent application Ser. No. 09/974,320, filed on Oct. 10, 2001 now abandoned. The entire disclosure of this patent application is hereby incorporated by reference into this specification.

FIELD OF THE INVENTION

A multi-stage process for drying coal in a fluidized bed reactor.

BACKGROUND OF THE INVENTION

Several United States patents have issued to the applicant for drying coal in a fluidized bed reactor. These include U.S. Pat. No. 5,830,246 ("Process for processing coal"), U.S. Pat. No. 5,830,247("Process for processing coal"), U.S. Pat. No. 5,858,035("Process for processing coal"), U.S. Pat. No. 5,904,741("Process for processing coal"), and U.S. Pat. No. 6,162,265("Process for processing coal"). The entire disclosure of each of these United States patens is hereby incorporated by reference into this specification.

Applicant's U.S. Pat. No. 6,162,265 illustrative of these patents. It describes and claims "1. A process for preparing an irreversibly dried coal, comprising the steps of: (a) providing a first fluidized bed reactor comprised of a first fluidized bed with a fluidized bed density of from about 30 to about 50 pounds per cubic foot, wherein said first fluidized bed is maintained at a temperature of from about 480 to about 600 degrees Fahrenheit, (b) feeding to said first fluidized bed coal with a moisture content of from about 15 to about 30 percent and a particle size such that all of the coal particles in such coal are in the range of from 0 to 2 inches, (c) feeding to said first fluidized bed liquid phase water, inert gas, and air, and subjecting said coal in said first fluidized bed to a temperature of from about 480 to about 600 degrees Fahrenheit for from about 1 to about 5 minutes while simultaneously comminuting and dewatering said coal, wherein:(i) while said coal is subjected in said first fluidized bed to said temperature of from about 480 to about 600 degrees Fahrenheit, it is comminuted, thereby producing at least one coarse fraction and at least one fine fraction, (ii) at least a portion of said fine fraction is entrained to a cyclone, and (iii) At least a portion of said fine fraction entrained to said cyclone is removed from said cyclone and fed to a cooler in which the temperature of said fine fraction is reduced by at least about 300 degrees Fahrenheit, (d) passing said comminuted and dewatered coal to a second fluidized bed reactor comprised of a second fluidized bed with a fluidized bed density of from about 30 to about 50 pounds per cubic foot, wherein said second fluidized bed is at a temperature of from about 215 to about 250 degrees Fahrenheit, wherein water, inert gas, and from about 0.5 to about 3.0 weight percent of mineral oil with an initial boiling point of at least about 900 degrees Fahrenheit is also fed to said second fluidized bed, and (e) reducing the temperature of said comminuted and dewatered coal from said temperature of from about 480 to about 600 degrees Fahrenheit to said temperature of from about 215 to about 250 degrees Fahrenheit in less than about 120 seconds."

The process described in U.S. Pat. No. 6,126,265 works well with reactors with a diameter of less than about 4 feet, which generally have an output of about 200 tons per day. With larger reactors, wherein the output(s) often exceed 1,000 tons per day, the process is often not as efficient. Without wishing to be bound to any particular theory, applicant believes that, as the size of the reactor increases, the gas velocity produced in the process increases geometrically, often to the point where the desired density of the fluidized bed used suffers. As the density of the fluidized bed declines, the efficiency of the drying process decreases.

It is an object of this invention to provide an improved process for drying coal that is efficient with larger fluidized bed reactors.

SUMMARY OF THE INVENTION

In accordance with this invention, there is provided a multi-stage process for drying coal. In the first stage of the process, a coal with a moisture content of from about 15 to about 40 percent is heated in a first fluidized bed reactor at a temperature of between about 400 to about 550 degrees Fahrenheit until from about 40 to about 60 percent of the water in such coal is removed and until at least about 50 percent of the particles less than about 400 microns are removed; during this process, air is fed into the first fluidized bed reactor at a rate of from about 5 to about 8 feet per second. In the second stage of the process, the coal treated the first fluidized bed reactor is heated in a second fluidized bed reactor at a temperature of from about 550 to about 650 degrees Fahrenheit until less than 1 weight percent of water remains in such coal; the temperature used in the second fluidized bed reactor is at least about 50 degrees greater than the temperature used in the first fluidized bed reactor; during this process, air is fed into the second fluidized bed reactor at a rate of from about 8 to about 12.2 feet per second.

BRIEF DESCRIPTION OF THE DRAWINGS

The invention will be described by reference to the specification and the drawings, in which like numerals refer to like elements, and wherein.

DESCRIPTION OF THE PREFERRED EMBODIMENTS

Figure 1:
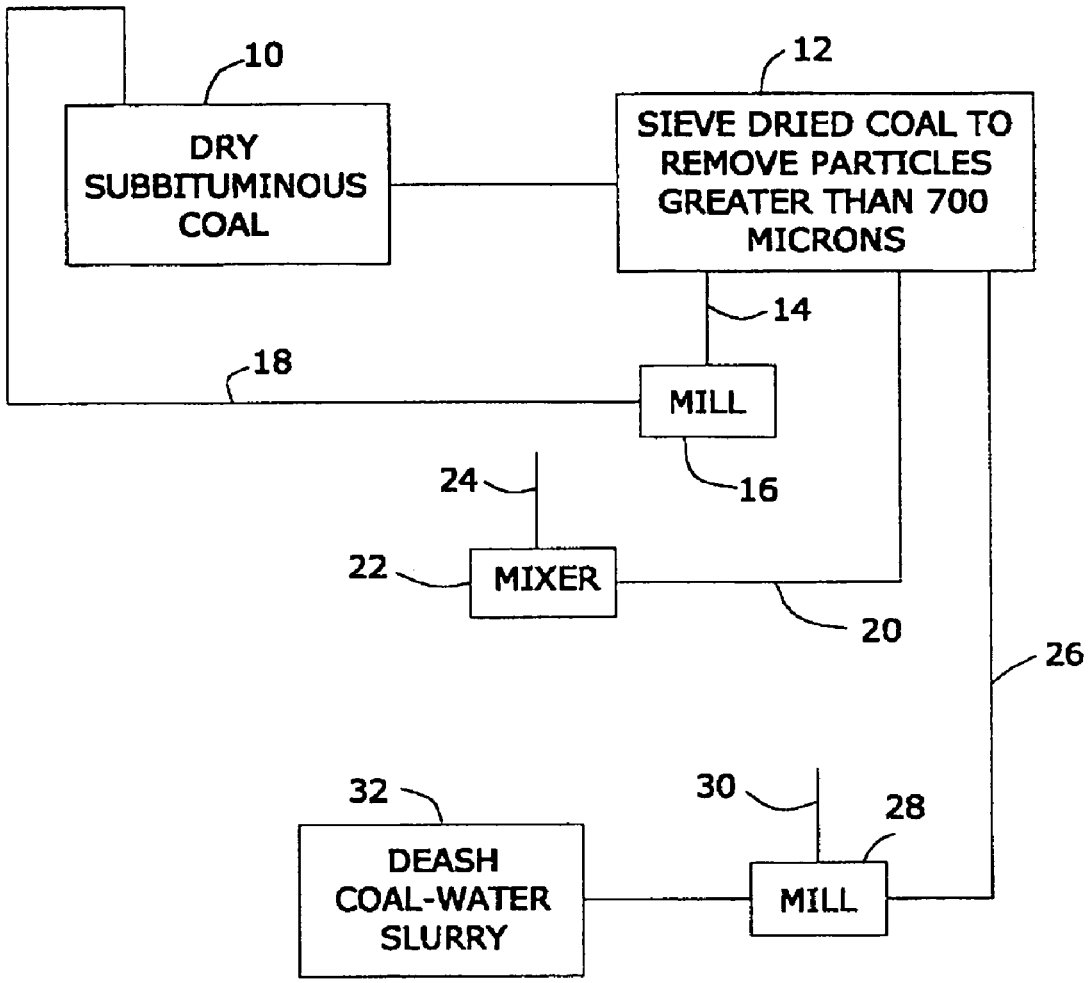
FIG. 1 is a schematic of one preferred process for preparing a coal-water slurry.

FIG. 1 is a schematic of one preferred process for preparing a coal-water slurry.

As is disclosed in applicant's U.S. Pat. Nos. 5,830,246 and 5,830,247, the entire disclosure of each of which is hereby incorporated by reference into this specification, many coals contain from about 15 to about 40 weight percent of moisture.. Thus, and referring to Column 1 of U.S. Pat. No. 5,830,246 (see lines 7 et seq.), "Many coals contain up to about 30 weight percent of moisture. This moisture not only does not add to the fuel value of the coal, but also is relatively expensive to transport."

In one embodiment, the coal used in the process of this specification is similar to the coal used in the process of U.S. Pat. No. 5,830,246. Thus, and referring again to U.S. Pat. No. 5,830,246 (see Column 2), "It is preferred that the coal used in the process of FIG. 1 contain from about 5 to about 30 weight percent of moisture and, more preferably, from about 10 to about 30 weight percent of moisture." However, in the instant case, the coal used may often contain up to about 40 weight percent of water.

As is also disclosed in column 2 of U.S. Pat. No. 5,830,246, ". . . the moisture content of coal may be determined by conventional means in accordance with standard A.S.T.M. testing procedures. Means for determining the moisture content of coal are well known in the art; see, e.g., U.S. Pat. Nos. 5,527,365 (irreversible drying of carbonaceous fuels), U.S. Pat. Nos. 5,503,646, 5,411,560 (production of binderless pellets from low rank coal), U.S. Pat. Nos. 5,396,260, 5,361,513 (apparatus for drying and briquetting coal), U.S. Pat. No. 5,327,717, and the like. The entire disclosure of each of these United States patents is hereby incorporated by reference into this specification."

In one preferred embodiment, the coal used in the process of this invention contains from about 10 to about 25 percent of combined oxygen. The combined oxygen content of certain coals, and means for determining them, are described in column 2 of U.S. Pat. No. 5,830,246, wherein it is disclosed that "It is also preferred that the coal used in the process of FIG. 1 contain from about 10 to about 20 weight of combined oxygen, in the form, e.g., of carboxyl groups, carbonyl groups, and hydroxyl groups. As used in this specification, the term "combined oxygen" means oxygen which is chemically bound to carbon atoms in the coal. See, e.g., H. H. Lowry, editor, "Chemistry of Coal Utilization" (John Wiley and Sons, Inc., New York, N.Y., 1963) . . . . The combined oxygen content of such coal may be determined, e.g., by standard analytical techniques; see, e.g., U.S. Pat. Nos. 5,444,733, 5,171,474, 5,050,310, 4,852,384 (combined oxygen analyzer), U.S. Pat. No. 3,424,573, and the like. The disclosure of each of these United States patents is hereby incorporated by reference into this specification."

In one embodiment, the coal used in the process of the instant invention contains from about 10 to about 25 weight percent of ash. Ash-containing coals are also described in column 2 of U.S. Pat. No. 5,830,246, wherein it is disclosed that "In one embodiment, the coal charged to feeder 12 contains at least about 10 weight percent of ash. As used herein, the term ash refers to the inorganic residue left after the ignition of combustible substances; see, e.g., U.S. Pat. No. 5,534,137 (high ash coal), U.S. Pat. No. 5,521,132 (raw coal fly ash), U.S. Pat. No. 4,795,037 (high ash coal), U.S. Pat. No. 4,575,418 (removal of ash from coal), U.S. Pat. No. 4,486, 894 (method and apparatus for sensing the ash content of coal), and the like. The disclosure of each of these United States patents is hereby incorporated by reference into this specification. By way of further illustration, one suitable ash containing coal which may be used in this embodiment is Herrin number 6 coal, from Illinois."

The coal produced by the process of U.S. Pat. No. 5,830, 246, when subbituminous coal is used as the starting material, has a particle distribution that renders it unsuitable for making a stable slurry. When this coal is mixed with from about 25 to about 35 weight percent of water (by total weight of water and coal), the slurry thus produced is unstable.

It is an object of one embodiment of this invention to provide a stable coal-water slurry made from subbituminous coal, wherein said slurry has a solids content of at least 65 weight percent and a heating value that is at least about 80 percent of the heating value of the undried coal. FIG. 1 is a flow diagram of one preferred aspect of this embodiment.

Referring to FIG. 1, and to the preferred embodiment depicted therein, in step 10 subbituminous coal is dried to a moisture content of less than about 5 percent.

In one embodiment, the process of the instant specification is used to dry such coal. This process will be described elsewhere in this specification, by reference to FIGS. 2, 3, and 4.

In one embodiment, the process of U.S. Pat. No. 5,830,246 is utilized to dry such coal; the entire disclosure of such patent is hereby incorporated by reference into this specification. This patent describes and claims: ".A process for preparing an irreversibly dried coal, comprising the steps of: (a) providing a fluidized bed reactor with a fluidized density of from about 10 to about 40 pounds per cubic foot; (b) maintaining said fluidized bed reactor at a temperature of from about 225 to about 500 degrees Fahrenheit; (c) feeding to said fluidized bed reactor coal with a moisture content of from about 5 to about 30 percent and a combined oxygen content of from about 10 to about 20 percent; (d) feeding to said reactor from about 0.5 to about 3.0 weight percent (by weight of dried coal) of mineral oil with an initial boiling point of at least about 900 degrees Fahrenheit, thereby producing a coated coal; and (e) subjecting said coated coal to said temperature of from about 225 to about 500 degrees Fahrenheit in said reactor for from about 1 to about 5 minutes while simultaneously comminuting and dewatering said coated coal, whereby a comminuted coal is produced wherein: (1.) after said coated coal is exposed to an ambient environment at a temperature of 25 degrees Centigrade and a relative humidity of 50 percent, it contains less than 2.0 percent of moisture, by weight of coal, (2.) at least about 80 weight percent of the particles of said coated coal are smaller than 74 microns, and (3.) said coal has a combined oxygen content of from about 10 to about 20 weight percent."

In another embodiment, the process of U.S. Pat. No. 5,830, 247 is used in order to prepare the dried subbituminous coal. This patent describes and claims: "A process for preparing an irreversibly dried coal, comprising the steps of: (a) providing a first fluidized bed reactor with a fluidized bed density of from about 20 to about 40 pounds per cubic foot, wherein said reactor is maintained at a temperature of from about 150 to about 200 degrees Fahrenheit, (b) feeding to said reactor coal with a moisture content of from about 15 to about 30 percent, an oxygen content of from about 10 to about 20 percent, and a particle size such that all of the coal particles in such coal are in the range of from 0 to 2 inches, (c) subjecting said coal in said first fluidized bed reactor to said temperature of from about 150 to about 200 degrees Fahrenheit for from about 1 to about 5 minutes while simultaneously comminuting and dewatering said coal, (d) passing said comminuted and dewatered coal to a second fluidized bed reactor with a fluidized bed density of from about 20 to about 40 pounds per cubic feet, wherein said reactor is at a temperature of from about 480 to about 600 degrees Fahrenheit, (e) feeding to said second fluidized bed reactor from about 0.5 to about 3.0 weight percent (by weight of dried coal) of mineral oil with an initial boiling point of at least about 900 degrees Fahrenheit, thereby producing a coated coal, (f) subjecting said coated coal to said temperature of from about 480 to about 600 degrees Fahrenheit for from about 1 to about 5 minutes while simultaneously comminuting and dewatering said coated coal, whereby a comminuted and dehydrated coal is produced."

Applicant has discovered that, because of his use of a particular subbituminous coal with specified properties, the drying step 10 is critical in order for him to obtain a stable slurry. It should be noted that other coals often do not require such a drying step in order to produce a stable slurry.

Thus, by way of illustration and not limitation, in U.S. Pat. No. 4,282,006 (the entire disclosure of which is hereby incorporated by reference into this specification), the preparation of a 75 weight percent coal-water slurry using coal from the Black Mesa mine is described (see Example 3). The properties and chemical composition of such coal is not described in U.S. Pat. No. 4,282,006.

Without wishing to be bound to any particular theory, applicant believes that the "Black Mesa" coal described in U.S. Pat. No. 4,282,006 did not have a combined oxygen content of from about 10 to about 25 percent. If it had, applicant believes, one would not have been able to make a stable slurry from it by drying.

Applicant has discovered that, when coal with an oxygen content of from about 10 to about 25 percent is mixed with a sufficient amount of water to produce a slurry with a solids content of from about 65 to about 75 weight percent, such slurry is often not stable. When such coal is first dried and then modified in accordance with steps 12 et seq. may a stable slurry may often be made from such coal."

Referring again to FIG. 1, and in the preferred embodiment depicted therein, after the dried coal has been produced in step 10, it is subject to a sieving operation in step 12 to remove oversize particles. It is preferred, in such an operation, to remove all of the particles greater than about 700 microns. In one embodiment, all particles greater than about 500 microns are removed.

The oversize particles are then fed via line to mill 16, wherein they are ground and then recycled via line 18 to the dry subbuminous coal supply 10.

The undersize particles may be fed via line 20 to mixer 22. In mixer 22, a sufficient amount of water is added via line 24 to produce a coal/water mixture with a solids content (by weight of dry coal) of from about 65 to about 75 weight percent. Additionally, one may add dispersing agent and/or electrolyte in accordance with the process described in U.S. Pat. No. 4,282,006, the entire disclosure of which is hereby incorporated by reference into this specification.

Referring again to FIG. 1, and in the preferred embodiment depicted therein, in one aspect of this embodiment the sieved, dried coal is fed via line 26 to mill 28 (which may be, e.g., a ball mill) in which the coal is preferably ground to the particle size distribution described in U.S. Pat. No. 4,282,006. In particular, the coal is ground until at least about 5 weight percent of its particles are of colloidal size, and until a coal compact is produced that is described by the "CPFT" formula set forth in claim 1 of U.S. Pat. No. 4,282,006.

Referring again to FIG. 1, one may add one or more other coal compacts to the mill 28 via line 30, and/or one may add water and/or surfactant and/or electrolyte.

In one embodiment, and referring again to FIG. 1, the coal-water slurry produced in mill 28 is deashed in step 32. In one embodiment, the deashing process described in U.S. Pat. No. 4,468,232 is used; the entire disclosure of such United States patent is hereby incorporated by reference into this specification.

U.S. Pat. No. 4,468,232 describes and claims: "A process for preparing a clean coal-water slurry, comprising the steps of: (a) providing a coal-water mixture comprised of from about 60 to about 80 volume percent of solids; (b) grinding said coal-water mixture until a coal-water slurry is produced wherein: 1. said slurry has a yield stress of from about 3 to about 18 Pascals and a Brookfield viscosity at a solids content of 70 volume percent, ambient temperature, ambient pressure, and a shear rate of 100 revolutions per minute, of less than 5,000 centipoise;2. said slurry is comprised of a consist of finely divided particles of coal dispersed in water, and said consist has a specific surface area of from about 0.8 to about 4.0 square meters per cubic centimeter and an interstitial porosity of less than about 20 volume percent; 3. from about 5 to about 70 weight percent of said finely divided particles of coal in said water are of colloidal size, being smaller than about 3.0 microns; 4. said consist of finely divided particles of coal has a particle size distribution substantially in accordance with the following formula:

$$\frac{CPFT}{100} = \sum_{j=1}^{k}\left[X_j\left(\frac{D^{Nj} - D_{sj}^{Nj}}{D_{Lj}^{Nj} - D_{sj}^{Nj}}\right)\right]$$

$$\text{where } \sum_{j=1}^{k} X_j = 1.0$$

$$\text{and where if } D < D_{sj}\left(\frac{D^{Nj} - D_{sj}^{Nj}}{D_{Lj}^{Nj} - D_{sj}^{Nj}}\right) = 0.0$$

$$\text{and where if } D > D_{Lj}\left(\frac{D^{Nj} - D_{sj}^{Nj}}{D_{Lj}^{Nj} - D_{sj}^{Nj}}\right) = 1.0$$

wherein: (a) CPFT is the cumulative percent of said solid carbonaceous material finer than a certain specified particle size D, in volume percent; (b) k is the number of component distributions in the compact and is at least 1; (c) Xj is the fractional amount of the component j in the compact, is less than or equal to 1.0, and the sum of all of the Xj's in the consist is 1.0; (d) N is the distribution modulus of fraction j and is greater than about 0.001; (e) D is the diameter of any particle in the compact and ranges from about 0.05 to about 1180 microns; (f) Ds is the diameter of the smaller particle in fraction j, as measured at 1% CPFT on a plot of CPFT versus size D, is less than DL, and is greater than 0.05 microns; and (g) DL is the diameter of the size modulus in fraction j, measured by sieve size or its equivalent, and is from about 15 to about 1180 microns; 5. at least about 85 weight percent of the coal particles in the consist have a particle size less than about 300 microns; and 6. the net zeta potential of said colloidal sized particles of coal is from about 15 to about 85 millivolts; and (c) cleaning said coal."

A Multistage Process for Drying Coal

Figure 2:
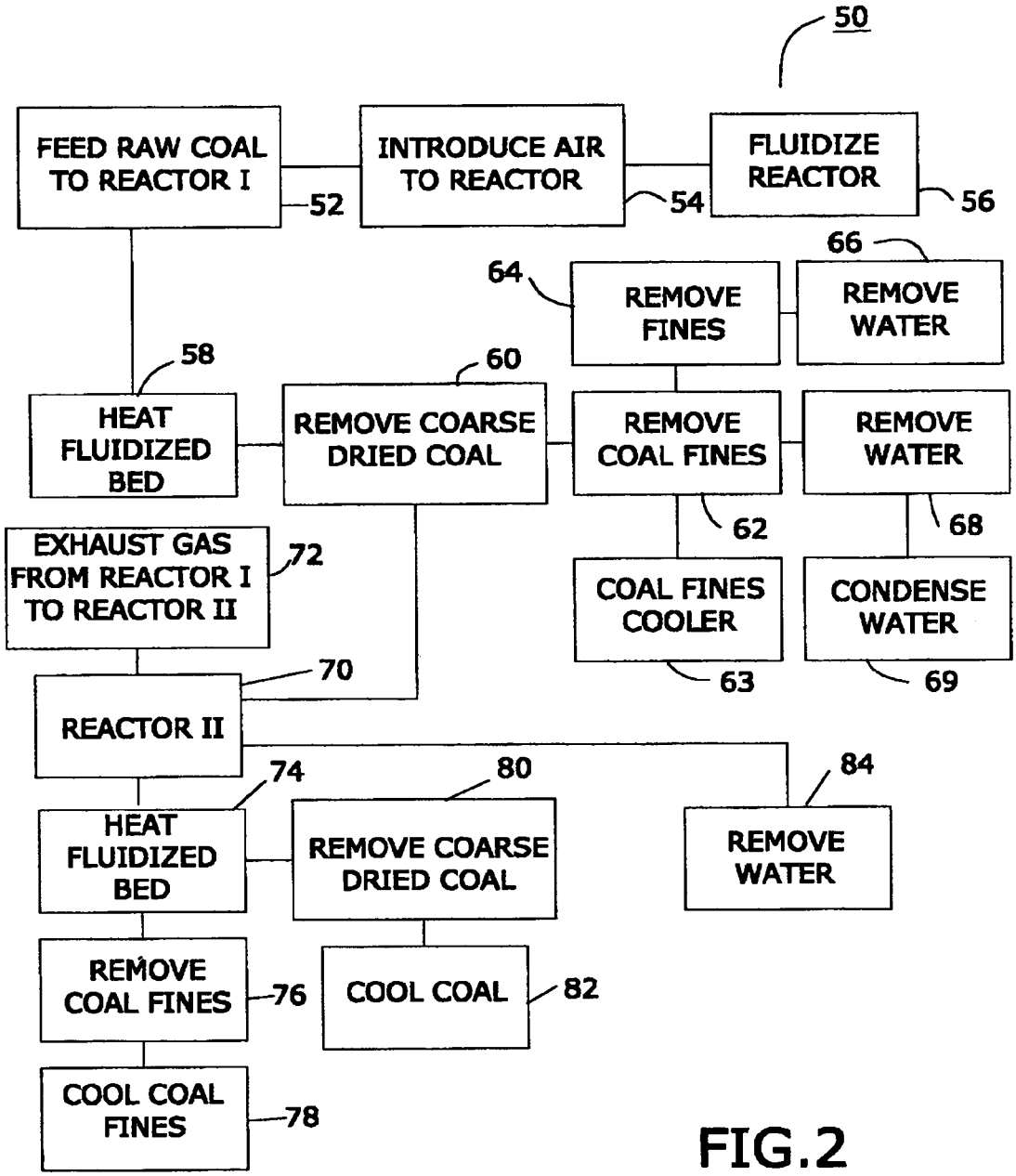
FIG. 2 is a schematic of one preferred process for drying the coal used in the process of FIG. 1.

FIG. 2 is a flow diagram of one preferred process 50 for drying coal. In step 52 of the process, raw coal is fed to reactor 1.

The coal used in process 50 is similar to the coal described in column 1 (see lines 16-61 of column 3) of U.S. Pat. No. 65,162,265, with the exception that it preferably contains from about 15 to about 40 weight percent of moisture, may contain from about 10 to about 25 weight percent of combined oxygen, and may contain from about 10 to about 25 weight percent of ash.

The coal used in process 50 may be lignitic or sub-bitiminous coal. Thus, and as is disclosed at lines 62 et seq. of column 3 of U.S. Pat. No. 6,162,265, " . . . the coal which is added to feeder assembly 12 may be, e.g., lignite, sub-bituminous, and bituminous coals. These coals are described in applicant's U.S. Pat. No. 5,145,489, the entire disclosure of which is hereby incorporated by reference into this specification."

In one preferred embodiment, the coal used in step 52 is 2"×0", and more preferably 2" by ¼" or smaller. As is known to those skilled in the art, 2" by ¼" coal has all of its particles within the range of from about 0.25 to about 2.0 inches.

Crushed coal conventionally has the 2"×0" particle size distribution. This crushed coal can advantageously be used in applicant's process.

Figure 3:
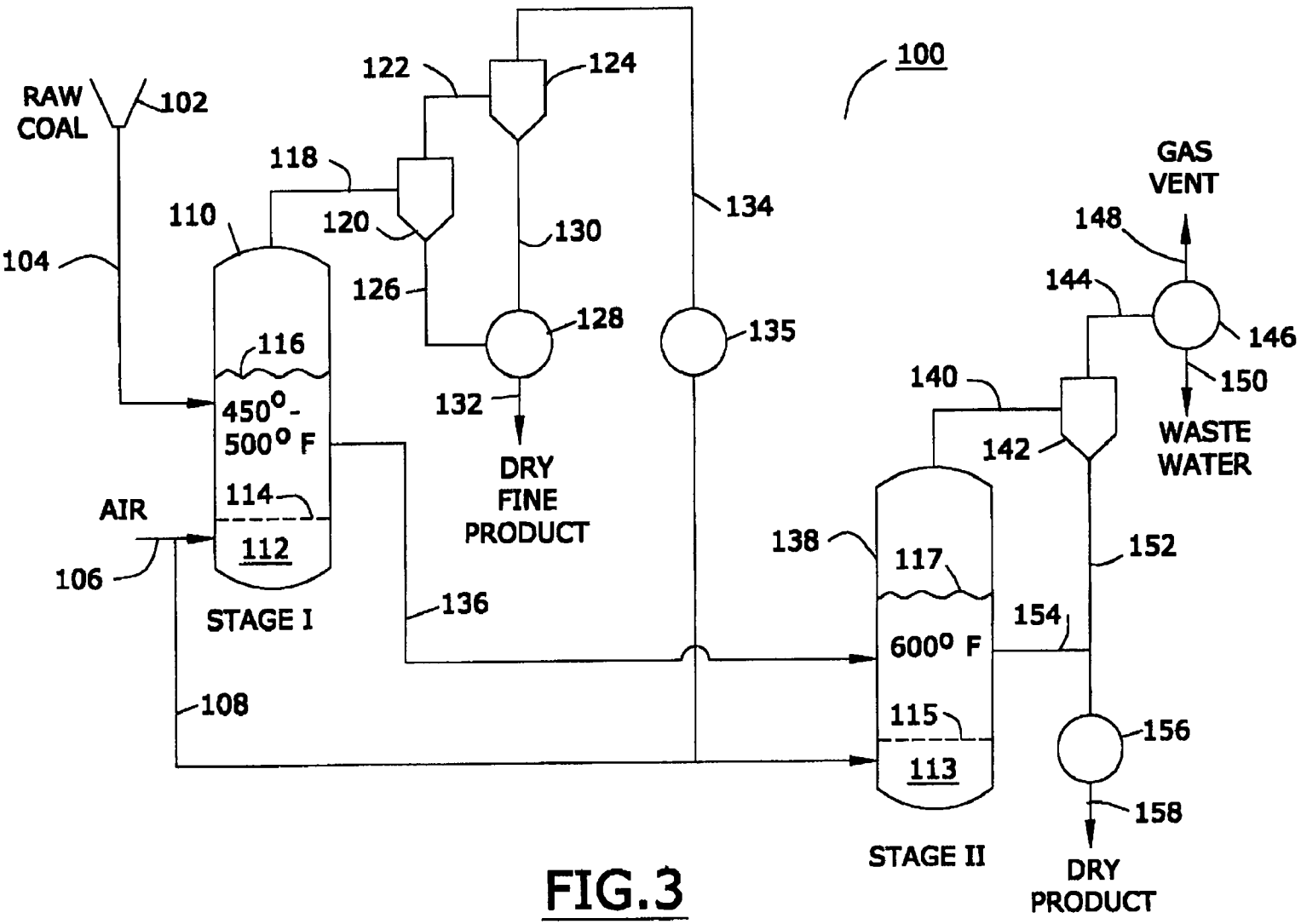
FIG. 3 is a schematic of one preferred apparatus that may be used in the process of FIG. 2.
Figure 4:
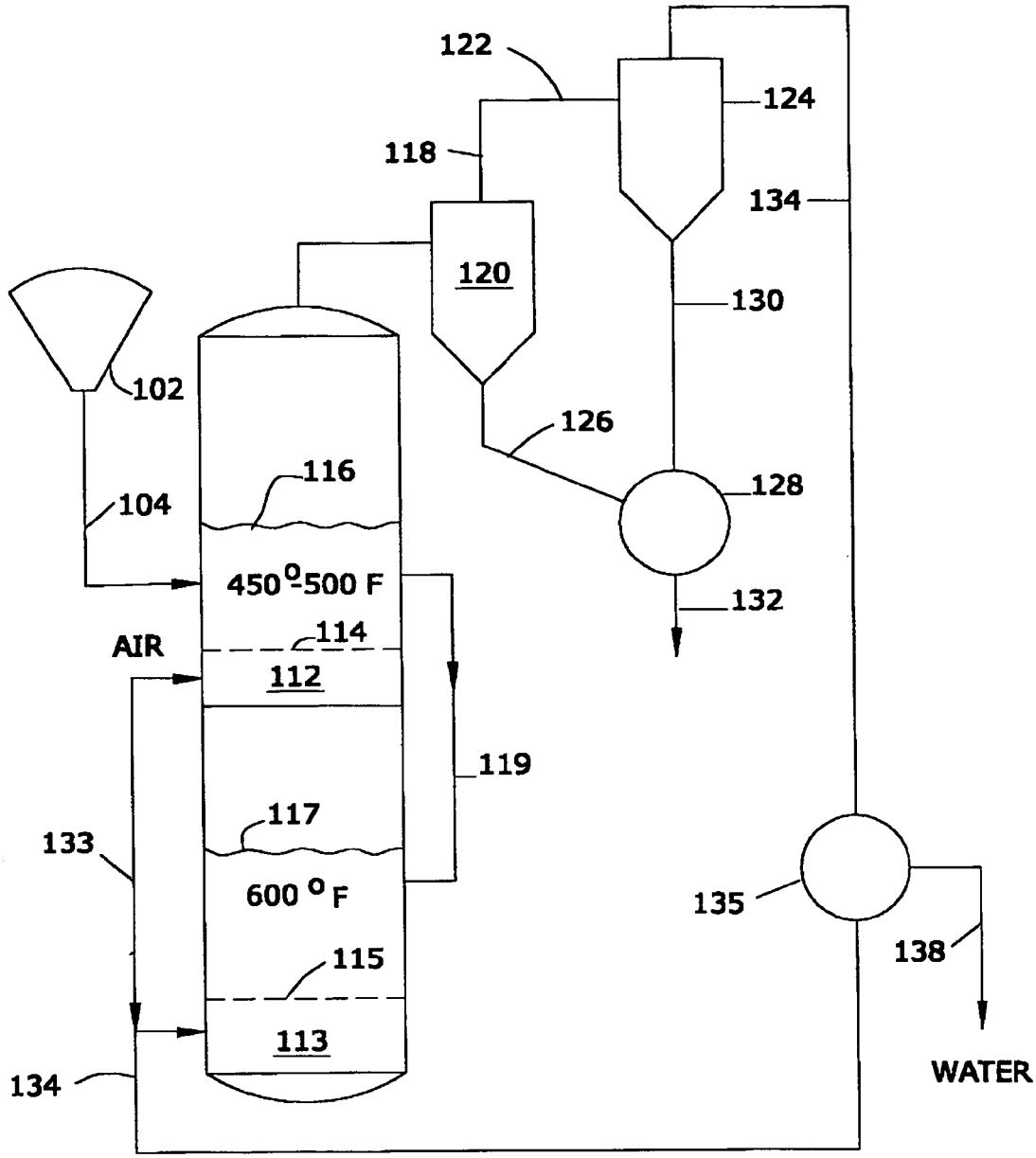
FIG. 4 is a schematic of another preferred apparatus that may be used in the process of FIG. 2.

Referring again to FIG. 2, and in the preferred embodiment illustrated therein, in step 52 the raw coal is preferably fed from a feeder 102 (see FIG. 3; also see FIG. 4). This feeder 102 may be similar to, or identical to the feeder 12 described in column 4 of U.S. Pat. No. 6,162,265, the entire disclosure of which is hereby incorporated by reference into this specification.

Referring to such column 4 of U.S. Pat. No. 6,162,265, it is disclosed that "... the coal is fed into feeder 12. Feeder 12 can be any coal feeder commonly used in the art. Thus, e.g., one may use one or more of the coal feeders described in U.S. Pat. Nos. 5,265,774, 5,030,054 (mechanical/pneumatic coal feeder), U.S. Pat. No. 4,497,122 (rotary coal feeder), U.S. Pat. Nos. 4,430,963, 4,353,427 (gravimetric coal feeder), U.S. Pat. Nos. 4,341,530, 4,142,868 (rotary piston coal feeder), U.S. Pat. No. 4,140,228 (dry piston coal feeder), U.S. Pat. No. 4,071,151 (vibratory high pressure coal feeder with helical ramp), U.S. Pat. No. 4,149,228, and the like. The disclosure of each of these United States patents is hereby incorporated by reference into this specification.

Referring again to FIG. 1, feeder 12 is comprised of a hopper (not shown) and a star feeder (not shown). It is preferred that feeder 12 be capable of continually delivering coal to fluidized bed 10."

U.S. Pat. No. 6,162,265 also discloses that "In one embodiment, not illustrated, a star feeder is used. A star feeder is a metering device which may be operated by a controller which controls the rate of coal removal from a hopper; see, e.g., U.S. Pat. No. 5,568,896, the entire disclosure of which is hereby incorporated by reference into this specification."

Referring again to FIG. 2, and in step 54 thereof, air is introduced into a first fluidized bed reactor. Referring to FIG. 3, and in the preferred embodiment depicted therein, air is introduced into reactor 110 via line 106.

The air may be introduced by conventional means such as, e.g., a blower (not shown). In one embodiment, the air so introduced preferably is hot air at a temperature of from about 250 to about 400 degrees Fahrenheit, and preferably from about 300 to about 350 degrees Fahrenheit.

The air is introduced via line 106 into a fluidized bed 112 in order to preferably maintain the temperature of such fluidized bed 112 at a temperature of from about 300 to about 550 degrees Fahrenheit and, more preferably, from about 450 to about 500 degrees Fahrenheit. Without wishing to be bound to any particular theory, applicant believes that this hot air helps oxidize a portion of the coal in the first reactor 110, thereby supplying energy required to vaporize the water in such coal.

In one preferred embodiment, the air is introduced via line 106 into fluidized bed 112 at a fluidizing velocity in the reactor vessel of greater than about 4 feet per second; the air is injected and, more preferably, greater than about 5 feet per second. In one aspect of this embodiment, the air is introduced via line 106 at a fluidizing velocity of from about 5 to about 8 feet per second. In another aspect of this embodiment, the air is introduced via line 6 at a fluidizing velocity of from about 6 to about 8 feet per second. Without wishing to be bound to any particular theory, applicant believes that maintaining the air flow within the desired ranges is essential for maintaining the desired conditions within the fluidized bed 112 and for conducting an efficient drying operation.

Referring again to FIG. 2, in step 56 of the process the reactor 110 is fluidized, i.e., a fluidized bed is established therein. One may establish such a fluidized bed by conventional means such as, e.g., the means disclosed in U.S. Pat. No. 6,162,265, at column 4 thereof. Referring to such column 4, it is disclosed that "... a fluidized bed 14 is provided in a reactor vessel 10. The fluidized bed 14 is comprised of a bed of fluidized coal particles, and it preferably has a density of from about 20 to about 40 pounds per cubic foot. In one embodiment, the density of the fluidized bed 20 is from about 20 to about 30 pounds per cubic foot. The fluidized bed density is the density of the bed while its materials are in the fluid state and does not refer to the particulate density of the materials in the bed .... Fluidized bed 14 may be provided by any of the means well known to those skilled in the art. Reference may be had, e.g., to applicant's U.S. Pat. Nos. 5,145,489, 5,547,549, 5,546,875 (heat treatment of coal in a fluidized bed reactor), U.S. Pat. No. 5,197,398 (separation of pyrite from coal in a fluidized bed), U.S. Pat. No. 5,087,269 (drying fine coal in a fluidized bed), U.S. Pat. No. 4,571,174 (drying particulate low rank coal in a fluidized bed), U.S. Pat. No. 4,495,710 (stabilizing particulate low rank coal in a fluidized bed), U.S. Pat. No. 4,324,544 (drying coal by partial combustion in a fluidized bed), and the like." In the process of this instant invention, air is fed into the fluidized bed to heat the fluidized bed and to maintain the bed at the desired density.

Without wishing to be bound to any particular theory, applicant believes that, in order to efficiently maintain the fluidized bed 112 at the desired density, the air flow into the fluidized bed should preferably be from about 5 to about 8 feet per second. Air flow outside of these ranges does not yield the desired results.

The reactors 110 and 138 are often cylindrical reactors that, a larger sizes, and when used with one-stage processes, often require gas velocities of about 18 feet per second or more. Without wishing to be bound to any particular theory, applicant believes that velocities of this magnitude often result in excessive entrainment of the fluidized bed and/or may distort the fluidization in the fluidized bed. In any event, velocities of this magnitude do not produce the drying results obtained with applicant's invention.

Referring again to FIG. 2, and in step 58 thereof, the fluidized bed 112 (see FIG. 3) is heated. One may heat the fluidized bed 112 by conventional means such as, e.g., using hot air provided in another reactor (not shown) and/or another device. Thus, e.g., one may provide the hot air to line 106 from a separate fluidized bed reactor. This option is discussed at lines 64 et seq. of column 4 of U.S. Pat. No. 6,162,265, wherein it is disclosed that "Fluidized bed 14 is preferably maintained at a temperature of from about 150 to about 200 degrees Fahrenheit. In a more preferred embodiment, the fluidized bed 14 is maintained at a temperature of from about 165 to about 185 degrees Fahrenheit. Various means may be used to maintain the temperature of fluidized bed 14 at a temperature of from about 150 to about 200 degrees Fahrenheit. Thus, e.g., one may use an internal or external heat exchanger (not shown). See, e.g., U.S. Pat. Nos. 5,537,941, 5,471,955, 5,442,919, 5,477,850, 5,462,932, and the like ... . In one embodiment, illustrated in FIG. 1, hot gas from, e.g., a separate fluidized bed reactor 18 is fed via line 20 into fluidized bed 14. This hot gas preferably is at temperature of from about 480 to about 600 degrees Fahrenheit and, more preferably, at a temperature of from about 525 to about 575 degrees Fahrenheit."

In another embodiment, not shown, the air fed via line 6 is hot air provided by a heat exchanger, not shown. Thus, e.g., one may use an internal or external heat exchanger (not shown). See, e.g., U.S. Pat. Nos. 5,537,941, 5,471,955, 5,442,919, 5,477,850, 5,462,932, and the like; the entire disclosure of each of these United States patents is hereby incorporated by reference into this specification.

Referring again to FIG. 3, and in the preferred embodiment depicted therein, it will be seen that a portion of the air fed via line 106 is diverted via line 108 into reactor 138, thereby effecting step 74 (the heating of the fluidized bed 113 in reactor 138). The air fed into reactor 113 is preferably fed at a velocity of from about 8 to about 12.2 feet per second. Without wishing to be bound to any particular theory, applicant believes that this rate of air flow in reactor 138 is essential to maintain the fluidized bed under the desired conditions and to obtain the desired efficiency of drying; the use of lower or higher air flow velocities is undesirable and ineffective.

Referring again to FIG. 2, in step 62 of the process, coal "fines" are removed from the reaction mass disposed within the fluidized bed 112. The finer coal portions (i.e., those with a particle size less than about 400 microns) are entrained from the top 116 of the fluidized bed to the cyclone 120 via line 118. The coarser component of the entrained stream will preferably be cooled in cooler 128, as are the coarser components from cyclone 124. In the embodiment illustrated in FIG. 3, the finer fraction from cyclone 120 is preferably passed via line 122 to cyclone 124. The coarser component from cyclone 124 is then fed to cooler 128; and the fraction so cooled is then passed to storage 132. The exhaust gas fed via line 134 is blended with the air in line 108, and the blended hot gases are then fed into the reactor 138.

One may use any of the cyclones known to the prior art; thus, e.g., one may use the cyclones disclosed in U.S. Pat. No. 6,162,265 (see, e.g., column 7 thereof). As is disclosed in such patent, One may use any of the cyclones conventionally used in fluid bed reactors useful for separating solids from gas. Thus, e.g., one may use as cyclone 54 the cyclones described in U.S. Pat. No. 5,612,003 (fluidized bed with cyclone), U.S. Pat. No. 5,174,799 (cyclone separator for a fluidized bed reactor), U.S. Pat. Nos. 5,625,119, 5,562,884, and the like. The entire disclosure of each of these United States patents is hereby incorporated by reference into this specification.

Referring again to FIG. 3, in reactor 110 water is removed from the coal fed via line 104. This step is also indicated, as step 68, in FIG. 2.

The raw coal fed via line 104 preferably contains from about 15 to about 40 weight percent of water. By comparison, the coal withdrawn via line 136 (see FIG. 3) contains from about 40 to about 60 percent less water. Put another way, the ratio of the water concentration in the raw coal divided by the water concentration in the dry coal is at from about 1.6 to about 2.5.

Referring again to FIG. 3, the water removed from the coal within the reactor 110 is passed together with flue gas and fines via line 118 to cyclone 120 and thence, via line 122 to cyclone 124. Thereafter, it passes via line 134 to condenser 135, wherein it is removed. The gas passing from condenser is preferably substantially dry, containing less than about 5 weight percent of water. Thereafter, this dry gas is mixed with the air in line 108 and thence fed into the fluidized bed 113 as its fluidizing medium.

Referring again to FIG. 3, the raw coal from feeder 102 is maintained in reactor 110 for a time sufficient to remove from about 40 to about 60 weight percent of the water in the raw coal. Generally, such "residence time" is preferably less than about 15 minutes and frequently is from about 5 to about 12 minutes.

Referring again to FIG. 2, and in step 60 thereof, the dried coal from reactor 110 is removed from such reactor and fed into reactor 138 via line 136. Simultaneously, or sequentially, in step 72 exhaust gas is fed (via line 108, see FIG. 3) from line 106, it is preferably mixed with dry gas from condenser 135, and it is then fed into fluidized bed 113.

In step 74 of the process, the fluidized bed 113 is heated to a temperature that preferably is at least 50 degrees Fahrenheit higher than the temperature at which fluidized bed 112 is maintained at. The temperature in fluidized bed 113 preferably is from about 450 to about 650 degrees Fahrenheit and, more preferably, from about 550 to about 600 degrees Fahrenheit.

The fluidized bed 113 is preferably heated by both the hot coal fed via line 136, and/or the heat in the gas fed via line 108, and/or the combustion processes involved in said fluidized bed (often referred to as "off gas"). In a manner similar to that depicted for reactor 110, water is removed from the coal in fluidized bed 113, and such coal is then discharged via line 154; in general, the water content of such coal is preferably less than about 1 weight percent.

The water removed from the coal in reactor 138 is fed via line 140 (together with "fines" and as) to cyclone 142 and thence via line 144 to a condenser 146; the waste water from condenser 146 is then removed via line 150. This step is depicted as step 84 in FIG. 2.

In step 76, the fines are removed from the reactor 138 via line 140. The solid product from cyclone 142 is then fed via line 152 and preferably blended with the dry coal from line 154. The blend is then fed to cooler 156, wherein it is preferably cooled to ambient temperature; and then is fed via line 158 to storage.

FIG. 4 is a schematic of a preferred apparatus which is similar to the apparatus depicted in FIG. 2 but utilizes a single, compartmentalized vessel instead of the two reactor vessels 110 and 138.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A multistage process for drying coal, comprising the steps of:

(a) charging coal to a first fluidized bed reactor, charging air to said first fluidized bed reactor at a velocity of from about 5 to about 8 feet per second, subjecting said coal to a first temperature of from about 300 to about 550 degrees Fahrenheit, and removing from about 40 to about 60 weight percent of the water in said coal from said coal, wherein:

1. said coal charged to said first fluidized bed reactor has a moisture content of from about 15 to about 40 percent and a combined oxygen content of from 10 to about 25 percent,
2. said first fluidized bed reactor is comprised of a fluidized bed with a fluidized bed density of from about 20 to about 50 pounds per cubic foot,
3. said air is fed into said first fluidized bed reactor and said first fluidized bed is maintained at a density of from about 20 to about 50 pounds per cubic foot while water is simultaneously removed from said first fluidized bed reactor, and
4. said air fed into said first fluidized bed reactor is at a temperature of from about 250 to about 400 degrees Fahrenheit.

whereby a first, partially dried coal is produced;

(b) feeding said first, partially dried coal into a second fluidized bed reactor, feeding air into said second fluidized bed reactor at a velocity of from about 8 to about 12.2 feet per second, subjecting said coal to a second temperature of from about 450 to about 650 degrees Fahrenheit, and removing water from said dried coal until no more than about 1 weight percent of water remains in said coal, wherein said second temperature is at least 50 degrees Fahrenheit greater than said first temperature.

2. The process as recited in claim 1, wherein said air fed into said first fluidized bed reactor is at said first temperature of from about 300 to about 350 degrees Fahrenheit.

3. The process as recited in claim 1, wherein said air is fed into said first fluidized bed reactor at a velocity of from about 6 to about 8 feet per second.

4. The process as recited in claim 1, wherein said coal charged to said first fluidized bed reactor is 2"×0" coal.

5. The process as recited in claim 1, wherein said coal charged to said first fluidized bed reactor is selected from the group consisting of lignitic coal, sub-bituminous coal, bituminous coal, and mixtures thereof.

6. The process as recited in claim 1, wherein said coal in said first fluidized bed reactor is maintained at said first temperature of from about 450 to about 500 degrees Fahrenheit.

7. The process as recited in claim 1, wherein said fluidized bed is maintained at a fluidized bed density of from about 20 to about 40 pounds per square inch.

8. The process as recited in claim 1, wherein said fluidized bed is maintained at a fluidized bed density of from about 20 to about 30 pounds per square inch.

9. The process as recited in claim 1, further comprising the step of heating said air prior to the time it is fed into said first fluidized bed reactor.

10. The process as recited in claim 9, wherein said air is heated by a heat exchanger prior to the time it is fed into said first fluidized bed reactor.

11. The process as recited in claim 1, further comprising the step of removing coal particles with a particle size less than about 400 microns from said first fluidized bed reactor.

12. The process as recited in claim 11, wherein said coal particles with a particle size less than about 400 microns that have been removed from said first fluidized bed reactor are fed into a cyclone.

13. The process as recited in claim 1, further comprising the step feeding gas into said second fluidized bed reactor.

14. The process as recited in claim 13, wherein said second temperature in said second fluidized bed reactor is from about 550 to about 600 degrees Fahrenheit.

* * * * *